United States Patent [19]

Hoffman

[11] 4,039,153

[45] Aug. 2, 1977

[54] GRINDING MILL

[76] Inventor: Douglas L. Hoffman, W. 3507 LaCrosse, Spokane, Wash. 99205

[21] Appl. No.: 680,490

[22] Filed: Apr. 26, 1976

[51] Int. Cl.[2] ..... B02C 7/14

[52] U.S. Cl. ..... 241/248; 241/259.1; 241/259.3; 241/261.2

[58] Field of Search ..... 241/244, 245, 248, 259.1, 241/259.3, 261.2, 261.3

[56] References Cited

U.S. PATENT DOCUMENTS

| | | | |
|---|---|---|---|
| 2,051,716 | 8/1936 | Johnson | 241/259.3 |
| 3,038,673 | 6/1962 | Fisher | 241/245 |
| 3,688,996 | 9/1972 | Kuest | 241/259.1 X |
| 3,841,573 | 10/1974 | Kahmann | 241/245 |
| 3,880,367 | 4/1975 | Grover | 241/248 |
| 3,942,730 | 3/1976 | Coucher | 241/261.2 X |

FOREIGN PATENT DOCUMENTS

| | | | |
|---|---|---|---|
| 40,137 | 4/1929 | Denmark | 241/245 |

*Primary Examiner*—Roy Lake
*Assistant Examiner*—Howard N. Goldberg
*Attorney, Agent, or Firm*—Wells, St. John & Roberts

[57] ABSTRACT

A mill for grinding flour and the like. Two flat grinding discs are mounted in opposed relation to one another. One disc is non-rotatably mounted with respect to the housing that supports it, while the other is rotated by a motor drive. The non-rotatable disc coaxially supports the shaft for the rotatable disc. The non-rotatable disc can be adjusted axially to vary the spacing between the grinding surfaces of the respective discs. Provision is also made for yieldable movement between the discs in response to the grinding load.

10 Claims, 5 Drawing Figures

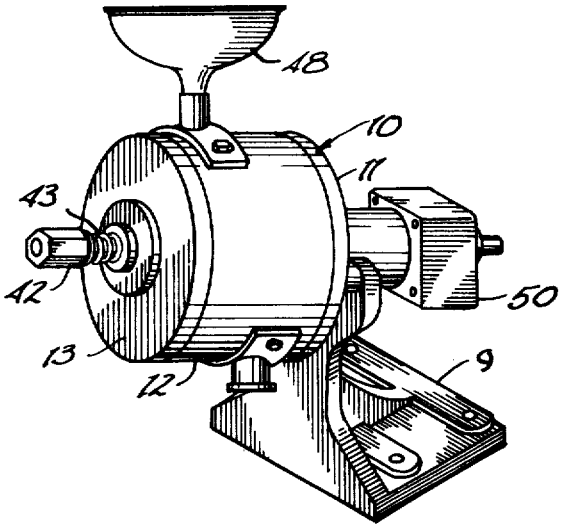
Fig. 1
Fig. 4
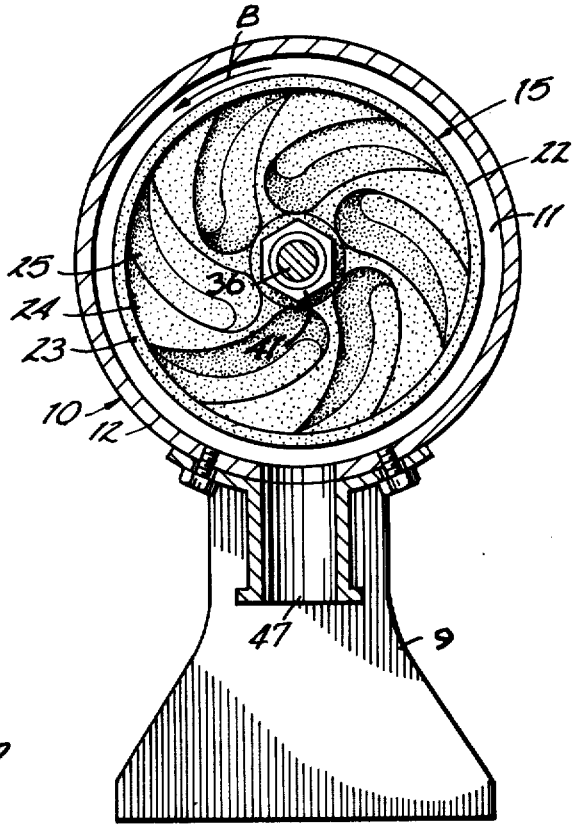
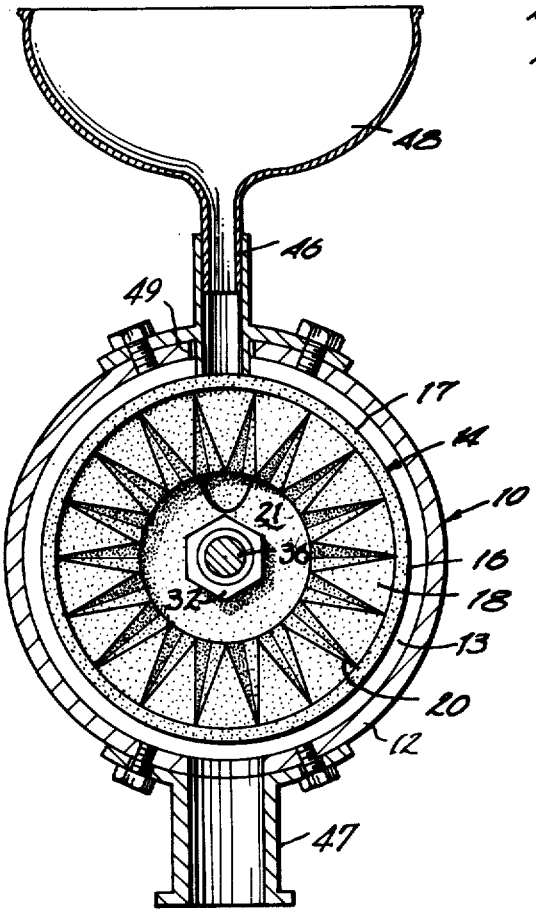
Fig. 3

48
46
3
4
49
17
12
10
22
13
34
45
43
36
27
31
25
24
11
15
A
32
41
42
44
26
37
35
30
31
40
21
A
14
18
20
25
24
38
36
16
12
23
22
9
47
3
4

GRINDING MILL

BACKGROUND OF THE INVENTION

The art of flour mills manufactured on a small scale for home use is extremely old, but the demand for such mills has evidenced a revival in recent years. The modern demand stems from the desire of many consumers to produce fresh, whole-grain flour in a fresh state, without addition of preservatives or additives. While some equipment is available to meet this demand, most mills are difficult to maintain due to their high rotational speeds. They often have little or no adjustment capability, which is extremely important if one is attempting to produce fine cake flour. They also are typically subject to overheating, which can damage the flour.

The basic features of the flour mill were illustrated many years ago in the Patent to Arnold, U.S. Pat. No. 3,468, which was patented in 18 44. This prior disclosure shows a grain mill having a stationary disc mounted to a framework and a powered disc rotatably journaled by the framework. No adjustment mechanism is visible in this disclosure, which is directed to the particular features of the metal cutters.

A similar structure was illustrated in a paint mill described in U.S. Pat. No. 7,630, which issued in 1850. Stationary and rotatable discs are mounted on opposed shafts. The non-rotatable disc is adjustable by means of a hand crank. Adjustment provided by this arrangement appears to have been rather coarse, however, it might have been acceptable at the speeds available for hand-operated grinding processes.

Later refinements in mills for various purposes are illustrated by the following prior patent disclosures: Baker U.S. Pat. No. 330,665, patented in 1885; Durham U.S. Pat. No. 891,050, patented in 1908; Richards U.S. Pat. No. 927,077, patented in 1909; Kihlgren U.S. Pat. No. 1,098,325, patented in 1914; Winegardner U.S. Pat. No. 1,286,865, patented in 1918; and Hogan U.S. Pat. No. 1,435,130, patented in 1922. These patents are primarily concerned with the configurations for moving material outward along the grinding surfaces of opposed discs in response to rotational and centrifugal forces.

The present disclosure arose from an effort to improve upon available commercial flour mills sold for consumer use to produce fresh kitchen flour. Experience with available mills encountered overheating of the flour, misalignment of the discs, and subsequent damage to the grinding surfaces. Many such mills have a very low flow rate through them and require considerable time to produce a usable amount of flour. Many of the available mills were also found to lack adjustment capabilities or the available adjustment features were too crude to permit milling of fine flour, such as is used for baking cakes. The mill described herein is capable of producing coarse or fine flour at a reasonable rotational speed and without dangerous overheating of the grain or flour during the milling process. The mill also makes use of a relatively economical material for the grinding discs, substantially reducing the production costs of the mill itself. Finally, the mill is capable of precision milling due to the coaxial support provided to both discs through the medium of the supporting housing structure. The mill design makes maximum us of gravitional flow to assure proper feeding and through-put between the grinding discs in conjunction with the available rotational and centrifugal forces.

SUMMARY OF THE INVENTION

The grinding mill disclosed and claimed herein is enclosed within a cylindrical housing having opposed end walls spaced along a reference axis. It includes a first non-rotatable grinding disc and a second opposed coaxial rotatable grinding disc. A hollow shaft is non-rotatably mounted on the end wall and centered along the reference axis. It has an inner end located within the housing. The hollow shaft is mounted to the end wall of the housing for axial movement relative to the housing along the reference axis. An adjustment member is movably mounted to the hollow shaft and engages the end wall of the housing to permit selective positioning of the axial location of the hollow shaft relative to the housing along the reference axis.

A coaxial, elongated shaft is rotatably journaled about the reference axis within the hollow shaft and at the remaining end wall of the housing. Suitable thrust bearings are utilized to prevent axial movement of the elongated shaft relative to the housing. The non-rotatable grinding disc is attached to the hollow shaft at a location in the housing. The rotatable grinding disc is attached to the elongated shaft at a location within the housing. The two disc have opposed complementary grinding surfaces that are formed on them and which are centered coaxially about the reference axis.

It is a first object of this invention to provide a novel arrangement of grinding discs and supporting shafts which permits precision adjustment of the axial positions of the discs relative to one another along a common axis. Since the discs are attached to coaxial shafts with one shaft supported within the other and both in effect supported between end walls of the housing, misalignment of the grinding surfaces during use or a result ofsubsequent wear cannot occur.

Another object of this invention is to provide a practical mill of economical design, which permits precise adjustment of the spacing between the grinding surfaces while the mill is being operated. The structure disclosed has a single adjustment member which can be operated during use of the mill so that the results of the adjustments can be immediately observed in the resulting milled product.

Another object of the invention is to provide a mounting arrangement for the grinding surfaces which permits the surfaces to yield axially relative to one another in response to loads imposed on them during grinding processes.

Another object is to provide a structural relationship between the discs which assures proper feeding of material to the grinding surfaces, making use of rotational, centrifugal and gravitational forces in combination with one another.

In addition, the structure disclosed herein can be readily assembled or disassembled for cleaning purposes. The grinding discs are easily replaced or removed for cleaning purposes. The entire device requires little or no maintenance and can be readily used by home consumers without considerable training or skills.

DESCRIPTION OF THE DRAWINGS

FIG. 1 is a perspective view of the mill;

FIG. 3 is a reduced sectional view taken along line 3—3 in FIG. 2;

FIG. 4 is a reduced sectional view taken along line 4—4 in FIG. 2; and

DESCRIPTION OF THE PREFERRED EMBODIMENT

Figure 2:
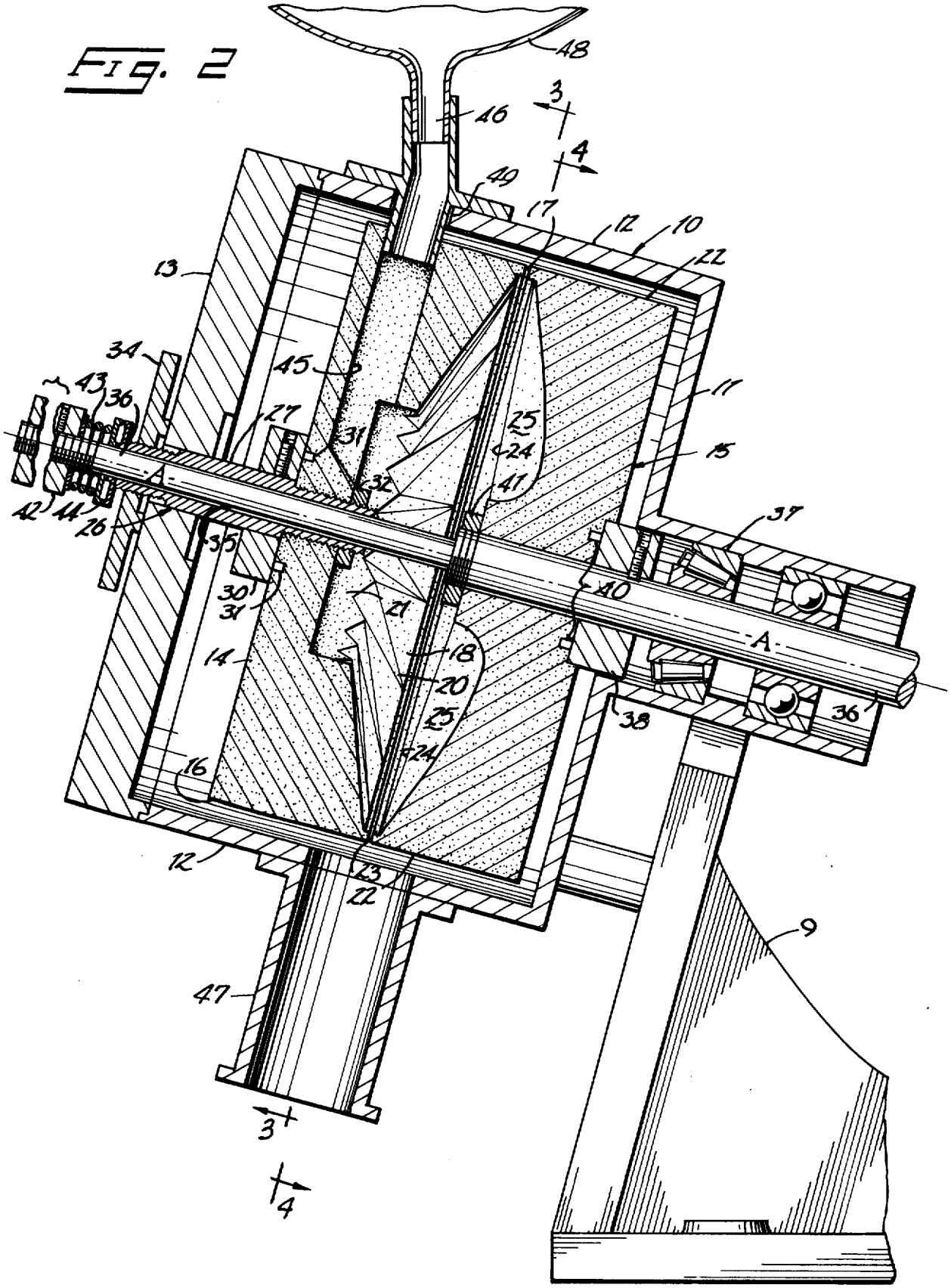
FIG. 2 is an elevational, sectional view taken along a vertical plane through a center axis of the mill.

The grinding mill shown in this application was designed specifically for use as a flour mill in home applications. It was designed as a relatively small mill powered by an electrical motor (not shown) and capable of use by a housewife or other users who desire the ability to produce fresh flour for any baking or cooking purposes. The design criteria required a simple mechanical structure that could be easily disassembled for cleaning. They also required an economical grinding medium. The flow rate through the unit had to be sufficiently great to make practical the production of flour without undue delay for machinery operation. Undue delays caused by overheating of the unit had to be eliminated. All of these factors entered into the design of the mill shown in the drawings, which is subject to variation in disc design, size relationships and choice of materials. However, the mounting of the discs and general arrangement of the grinding assembly is most important to its practical application as a kitchen tool.

In general, the mill is enclosed within a cylindrical housing 10 that is rigidly supported by a base 9. The base 9 can be bolted or clamped to a suitable working surface such as a table or bench. The housing includes two end walls, both circular in shape. The first end wall is provided by a removable cover 13 which is normally bolted or screwed to the surrounding cylindrical wall 12. The remaining end wall 11 is normally secured to the opposite end of the cylindrical wall 12 and remains in place.

Grinding occurs between two circular discs, although other configurations of grinding means could be substituted. The first disc 14 in non-rotatable relative to the housing 10. The second disc 15 rotates about a reference axis through the end walls of the housing 10, the axis being indicated by line A—A in FIG. 2. Discs 14, 15 are coaxially centered along A—A.

As seen in FIGS. 2 and 3, the non-rotatable grinding disc 14 is circular in shape, having a cylindrical, peripheral surface 16. Its grinding face, which is opposed to the grinding face of disc 15, is formed with an annular border 17 that extends about its complete periphery. The border 17 surrounds a planar face 18 having a series of points or radial star-shaped indented areas 20 formed therein. Each point of these star-shaped areas leads outwardly from the center recess 21 and diminishes in depth from the center of disc 14 toward its periphery. The disc 14 also is apertured at 45 for receiving incoming feed material. The aperture 45 extends vertically from the top of the peripheral surface 16 to the center of disc 14 in open communication with a center recess 21. Grain or other material can flow by gravitional force from the top of the stationary disc 14 to its center so as to move between the operative grinding surfaces of the two discs 14 and 15.

The rotatable grinding disc 15 is also formed with a cylindrical peripheral surface 22 of the same diameter as that of disc 14. Note FIGS. 2 and 4. Its grinding face has an annular border 23 identical in size and shape to the border 17. The border 23 surrounds a slightly recessed planar face 24 having a series of spiral-shaped indented areas 25 recessed therein. The spiral-shaped indented areas curve rearwardly in a direction opposite to the rotational movement imparted to the disc 15, which is indicated by arrow "B" in FIG. 4. The indented areas 25 decrease in depth from the center of disc 15 toward its periphery.

While the discs 14, 15 might be constructed of any suitable abrasive material capable of withstanding the grinding forces encountered during use of the mill, I have found that fired stoneware is exceptionally adaptable to the application and is relatively economical in comparison with harder materials, such as carburundum. The discs 14, 15 have been constructed from available clay used in production of pottery and china. To add durability to the discs, an available pottery glaze is mixed with the clay. The amount of glaze is preferably about five percent of to total volume of the clay being formed. After firing of the discs, I also glaze the surfaces of the discs on all but the surfaces of the borders 17, 23, which are unglazed for final grinding as discussed below. The glazing of the disc surfaces adds to the life of the discs and does not significantly detract from the grinding process desired.

To effectively use this mill, it must be rotated at relatively high speed and with very close tolerances between the two discs 14, 15. To produce usable cake flour, the border 17, 23 must be sufficiently close to one another that all flour particles passing between them will be reduced to a very small particle size. The clearance between the discs must be accurately maintained for consistent results and must be adjustable to permit movement of one disc toward the other with accuracy to compensate for surface wear and variations.

Figure 5:
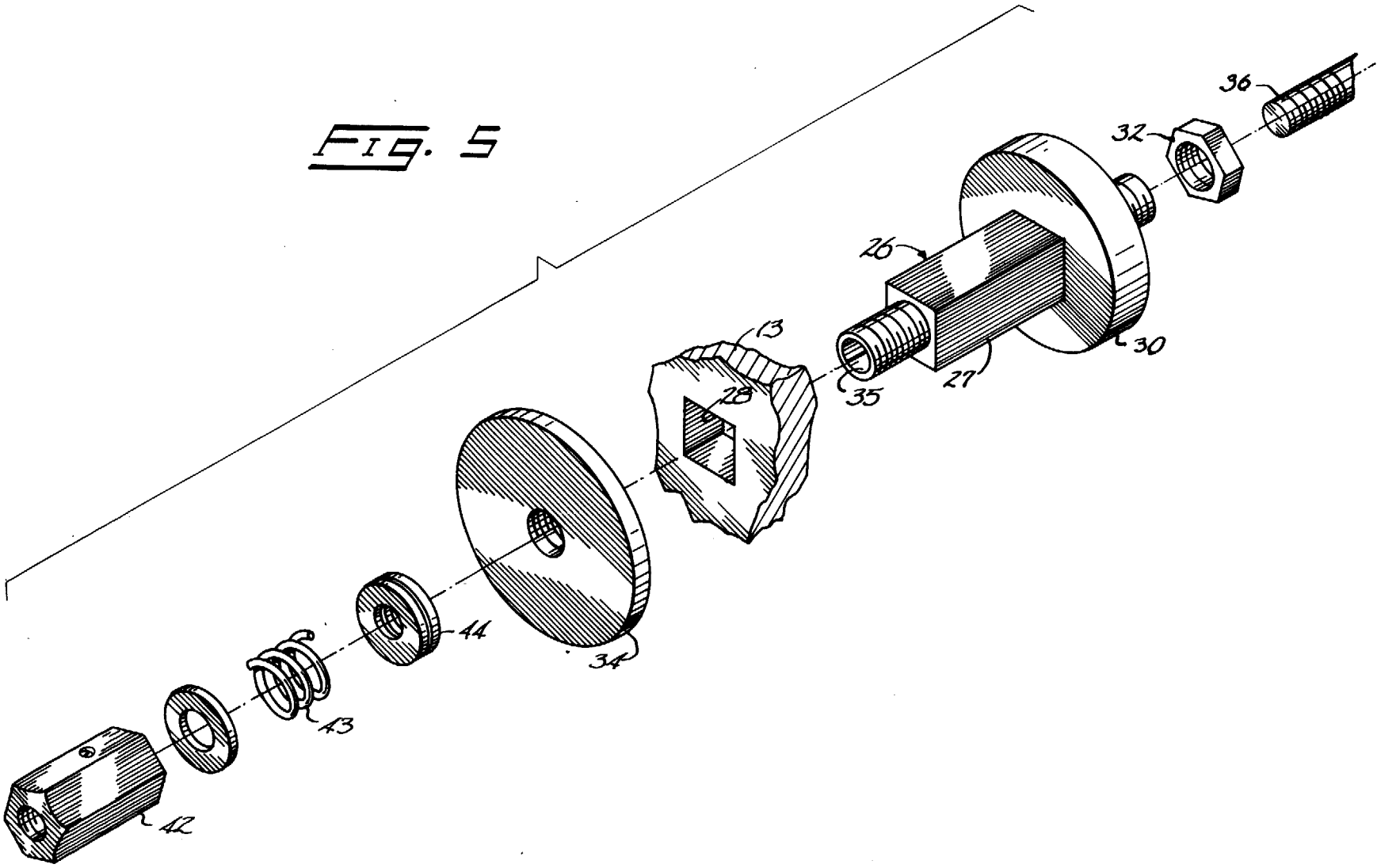
FIG. 5 is a fragmentary exploded view of the outer adjustment and support assembly for the grinding discs.

The discs are mounted coaxially along the reference axis A—A, which extends between the end walls of the housing 10. The precise mechanism by which coaxial alignment is maintained and adjustment is achieved in the structure can best be seen in FIGS. 2 and 5.

A hollow shaft 26 extends through cover 13 and terminates at an inner end located within the housing 10. The shaft 26 is supported by cover 13 along square outer surfaces 27 formed at the shaft exterior. The surfaces 27 slide axially within a complementary square aperture 28 machined through cover 13 and aligned along axis A—A. A collar 30 is fixed to the outer surfaces of hollow shaft 26 inward from cover 13 and has projecting axial pins 31 that fit within receiving apertures at the back surface of the non-rotatable grinding disc 14. The disc 14 is attached to the inner end of hollow shaft 26 by a retaining nut 32 threadably mounted to the inner end of shaft 26. The collar 30, pins 31 and retaining nut 32 secure disc 14 to the hollow shaft 26 and assure its maintenance at a position centered about the reference axis A—A.

The outer end of hollow shaft 26, which projects through the cover 13, is threaded. It is threadably engaged by an adjustment member 34 in the form of a knurled disc designed for manual adjustment. The member 34 bears against the outer surface of cover 13 and is used to vary the axial position of hollow shaft 26 relative to the housing 10 along the axis A—A.

The shaft 26 has an elongated longitudinal aperture 35 formed through its length and centered along axis A—A. This aperture forms a bearing surface, or journal, for a coaxial elongated shaft 36 which supports the rotatable grinding disc 15. Shaft 36 is rotatably supported within the hollow shaft 26 and within a thrust bearing 37 mounted to the end wall 11 of housing 10. Shaft 36, therefore, spans the two end walls of the housing and accurately aligns the entire grinding assembly along the reference axis A—A. A collar 38, having projecting pins 40, engages the rear surface of the grinding disc 15, which is held to the shaft 36 by a retaining nut 41. In this manner, the rotatable grinding disc 15 is also centered axially about the reference axis A—A.

The outer end of shaft 36 is threaded and is threadably engaged by a cap 42 which can be adjusted axially by turning it relative to shaft 36 while the shaft 36 is stationary. See FIGS. 2 and 5. A compression spring 43 and a small thrust bearing assembly 44 are interposed between the outer end of hollow shaft 26 and the inwardly facing radial surface of cap 42. Spring 43 permits the hollow shaft 26 to yield axially under load and move slightly outward relative to the shaft 36, which is restrained against axial movement by its supportive thrust bearing assembly 44. Cap 42 is normally pre-set on shaft 36 to preload spring 43 over the range of operational adjustment required between the grinding surfaces of the two discs 14, 15.

Material is fed through the non-rotatable grinding disc 14 by means of a feed aperture 49 formed at the top of the cylindrical wall 12 and a funnel or hopper 48 carried thereby. The aperture 49 should be slightly elongated so that the funnel or hopper 48 can move or flex to remain in communication with the aperture 45 in disc 14 over the normal range of axial adjustment. This is easily accommodated by using a flexible tube 46 at the outlet of the funnel or hopper 48.

The ground material is collected at the bottom of the housing 10 by means of a downspout 47 that is open through the cylindrical wall 12. The ground material can drop into a receiving container (not shown). The downspout 47 can also be used to hang a receiving bag secured about the outer surfaces of the downspout 47.

As illustrated, the reference axis A—A is inclined slightly with respect to the horizontal. This assists in proper gravitational feeding of material through the stationary disc and between the rotating grinding surfaces of the two discs 14, 15. It assures more rapid distribution of incoming material about the revolving surfaces of the disc 15.

In use, the shaft 36 is driven at its end beyond wall 11 by means of a geared transmission 50 powered by an electric motor or other source of rotational energy (not shown). The grinding action occurs between the opposed faces of discs 14, 15, which are designed to complement one another. The star-shaped recessed or indented areas on disc 14 direct incoming material radially outward across the faces of the discs, while the spiral-shaped indented areas 25 on the rotating disc 15 utilize centrifugal forces to move the material from the centers of the discs to their peripheries. The intersections of these indented areas with the planar faces 18, 24 of discs 14, 15 serve as cracking surfaces to initially break up the solid particles of material or grain.

The cracking or breaking of particles will occur repeatedly as the material or grain moves from the center of the discs to their outer edges. Finally, all the particles of material must pass between the annular borders 17, 23, which are pre-set to achieve the degree of fine grinding desired. The width of the borders 17, 23 must be such as to assure complete final grinding of each particle before it is thrown from between the discs by the rotational and centrifugal forces.

Accurate grinding and positioning of the discs 14, 15 is easily achieved by the arrangement illustrated. Each disc is accurately centered about the reference axis A—A by machining of the back surface of the disc which abuts the respective positioning collar 30 or 38. The closely opposed annular borders 17, 23 can also be accurately machined with reference to the access A—A. In this way the discs and the critical grinding borders 17, 23 can be accurately aligned along axis A—A. Such alignment is assured during use of the machine by the fact that both shafts 26, 36 are coaxial and supported jointly through the walls 11, 13 in the housing 10.

The thrust bearing assembly 37 rotatably mounts the shaft 36, but restrains it from axial movement. Axial movement is permitted at shaft 26, but is limited in an inward direction by the adjustable member 34 that bears against the outer surface of cover 13. Outward movement of shaft 26 is resisted by the force of spring 43 but is permitted when necessary in response to the loading material between the discs 14, 15. This permits the discs to yield slightly to avoid damage to the grinding surfaces if the unit should be accidently overloaded.

Adjustment of the spacing between the discs 14, 15 is achieved simply by turning the adjustment member 34, which is threadably engaged about the hollow shaft 26. This moves the inner end of shaft 26 and disc 14 along the reference axis A—A and can be accomplished whether the mill is at rest or in use. It is particularly advantageous in permitting adjustment during use of the mill, the result being instantly visible in the material that flows from the downspout 47.

This mill has been found to be particularly useful for grinding grain, soybeans, corn and other food materials. However, the mill structure could be usable in other applications for home or industrial use. The elements within housing 10 are readily disassembled or assembled for cleaning or replacement purposes. The mill makes full use of gravitational, rotational and centrifugal forces to feed and grind the material fed through it and has been found to operate with much less heating of its components than comparable mills available to the public.

Modifications can obviously be made in adapting this disclosure to specific applications, and for these reasons, only the following claims are intended as definitions of the disclosed invention.

Having thus described my invention, I claim:

1. In a grinding mill:

a housing having opposed end walls spaced from one another along an axis;

a hollow shaft non-rotatably mounted to one end wall and centered along said axis said hollow shaft having an inner end located within said housing, said hollow shaft being mounted to said one end wall for axial movement relative to the housing along said axis;

adjustment means operatively connected to said hollow shaft and said one end wall for selectively positioning the axial location of said hollow shaft relative to the housing along said axis;

a coaxial elongated shaft rotatably journalled about said axis within said hollow shaft and at the remaining end wall of said housing;

means mounted to said elongated shaft for preventing movement of the elongated shaft relative to the housing along said axis;

non-rotatable grinding means attached to said hollow shaft at a location within said housing;

rotatable grinding means attached to said elongated shaft at a location within said housing;

said non-rotatable and rotatable grinding means having opposed complementary grinding surfaces formed thereon, the grinding surfaces being centered coaxially about said axis; and means for imparting rotational movement to said elongated shaft about said axis.

2. The apparatus set out in claim 1 further comprising:

yieldable means operably connected between said hollow shaft and said elongated shaft for yieldably resisting axial movement of the inner end of the hollow shaft toward said one end wall of said housing.

3. The apparatus as set out in claim 2 wherein said adjustment means comprises a rotatable member threadably mounted to said hollow shaft and engaged with said one wall of the housing.

4. The apparatus as set out in claim 1 wherein said axis is inclined from the horizontal in a downwardly sloping direction from said one end wall toward said remaining end wall of the housing.

5. The apparatus as set out in claim 1 wherein said axis is inclined from the horizontal in a downwardly sloping direction from said one end wall toward said remaining end wall of the housing and wherein said rotatable grinding means is interposed between said non-rotatable grinding means and said remaining end wall of the housing.

6. The apparatus as set out in claim 1 wherein said axis is inclined from the horizontal in a downwardly sloping direction from said one end wall toward said remaining end wall of the housing and wherein said rotatable grinding means is interposed between said non-rotatable grinding means and said remaining end wall of the housing and material feed means formed through the top of the housing and non-rotatable grinding means and leading to said grinding surfaces for introducing material between said grinding surfaces.

7. The apparatus as set out in claim 1 wherein each of said grinding means comprises a stoneware disc of identical diameter mounted face-to-face with one another, the respective grinding surfaces comprising identical annular borders formed perpendicular to said axis and surrounding indented areas formed on the grinding surfaces for receiving and cracking material in response to relative rotation of said grinding means prior to final grinding of the material as it passes outward between the annular borders.

8. The apparatus set out in claim 7, further comprising:

material feed means formed through the top of the housing and non-rotatable grinding means and leading to the indented areas formed thereon for introducing material between said grinding surfaces.

9. The apparatus as set out in claim 1 wherein each of said grinding means comprises a disc having an abrasive grinding surface of identical diameter mounted face-to-face with one another, the respective grinding surfaces comprising identical annular borders formed perpendicular to said axis and projecting from parallel circular faces slightly recessed behind the borders;

one disc having star-shaped indented areas about its face radiating outward from its center to its border;

the remaining disc having spiral-shaped indented areas about its face radiating outward from its center to its border; and said indented areas of both discs decreasing in depth from their centers outward toward their borders.

10. The apparatus as set out in claim 1 wherein each of said grinding means comprising a disc having an abrasive grinding surface of identical diameter mounted face-to-face with one another, the respective grinding surfaces comprising identical annular borders formed perpendicular to said axis and projecting from parallel circular faces slightly recessed behind the borders;

the disc comprising the non-rotatable grinding means having star-shaped indented areas about its face radiating outward from its center to its border;

the disc comprising the rotatable grinding means having spiral-shaped indented areas about its face radiating outward from its center to its border;

said indented areas of both discs decreasing in depth from their centers outward toward their borders; and material feed means formed through the top of the housing and non-rotatable grinding means and leading to the indented areas formed thereon for introducing material between said grinding surfaces.

* * * * *